US010850953B2

(12) United States Patent
Mietschnig et al.

(10) Patent No.: US 10,850,953 B2
(45) Date of Patent: Dec. 1, 2020

(54) LIFTING DEVICE, IN PARTICULAR A MOBILE CRANE OR A CABLE-OPERATED EXCAVATOR, HAVING AN APPARATUS FOR MONITORING THE RAISING AND LOWERING PROCEDURES OF A BOOM SYSTEM AND CORRESPONDING METHOD

(71) Applicant: Liebherr-Werk Nenzing GmbH, Nenzing (AT)

(72) Inventors: Walter Mietschnig, Brand (AT); Manfred Schapler, Vandans (AT); Thomas Klimmer, St. Jakob (AT); Mathias Eder, Satteins (AT); Martin Stenech, Nüziders (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 256 days.

(21) Appl. No.: 16/012,223

(22) Filed: Jun. 19, 2018

(65) Prior Publication Data

US 2019/0185298 A1 Jun. 20, 2019

(30) Foreign Application Priority Data

Jun. 19, 2017 (DE) ..... 10 2017 113 386

(51) Int. Cl.

| | |
|---|---|
| ***B66C 23/90*** | (2006.01) |
| ***B66C 13/16*** | (2006.01) |
| ***B66C 13/46*** | (2006.01) |
| ***B66D 1/58*** | (2006.01) |
| ***B66F 17/00*** | (2006.01) |
| *B66C 15/00* | (2006.01) |
| *B66C 23/34* | (2006.01) |

(52) U.S. Cl.

CPC ..... *B66C 23/905* (2013.01); *B66C 13/16* (2013.01); *B66C 13/46* (2013.01); *B66C 23/90* (2013.01); *B66D 1/58* (2013.01); *B66F 17/006* (2013.01); *B66C 15/00* (2013.01); *B66C 23/34* (2013.01)

(58) Field of Classification Search

CPC ..... B66C 13/00; B66C 13/16; B66C 13/18; B66C 13/22; B66C 15/00; B66C 23/00; B66C 23/88; B66C 23/90; B66C 23/905

See application file for complete search history.

(56) References Cited

U.S. PATENT DOCUMENTS

2012/0312767 A1* 12/2012 Bohnacker ..... B66C 23/82 212/276
2016/0221799 A1* 8/2016 Muench ..... B66C 13/18
2017/0334686 A1* 11/2017 Hess ..... B66C 23/905
2017/0334687 A1* 11/2017 Wiest ..... B66C 15/065

FOREIGN PATENT DOCUMENTS

DE 10 2014 012 422 A1 2/2016
DE 20 2015 001 024 U1 5/2016

* cited by examiner

*Primary Examiner* — Michael R Mansen
*Assistant Examiner* — Juan J Campos, Jr.
(74) *Attorney, Agent, or Firm* — Dilworth & Barrese, LLP

(57) ABSTRACT

The invention relates to a lifting device, in particular a mobile crane or a cable-operated excavator, having an apparatus for monitoring the raising and lowering procedures of a boom system of the lifting device.

12 Claims, 1 Drawing Sheet

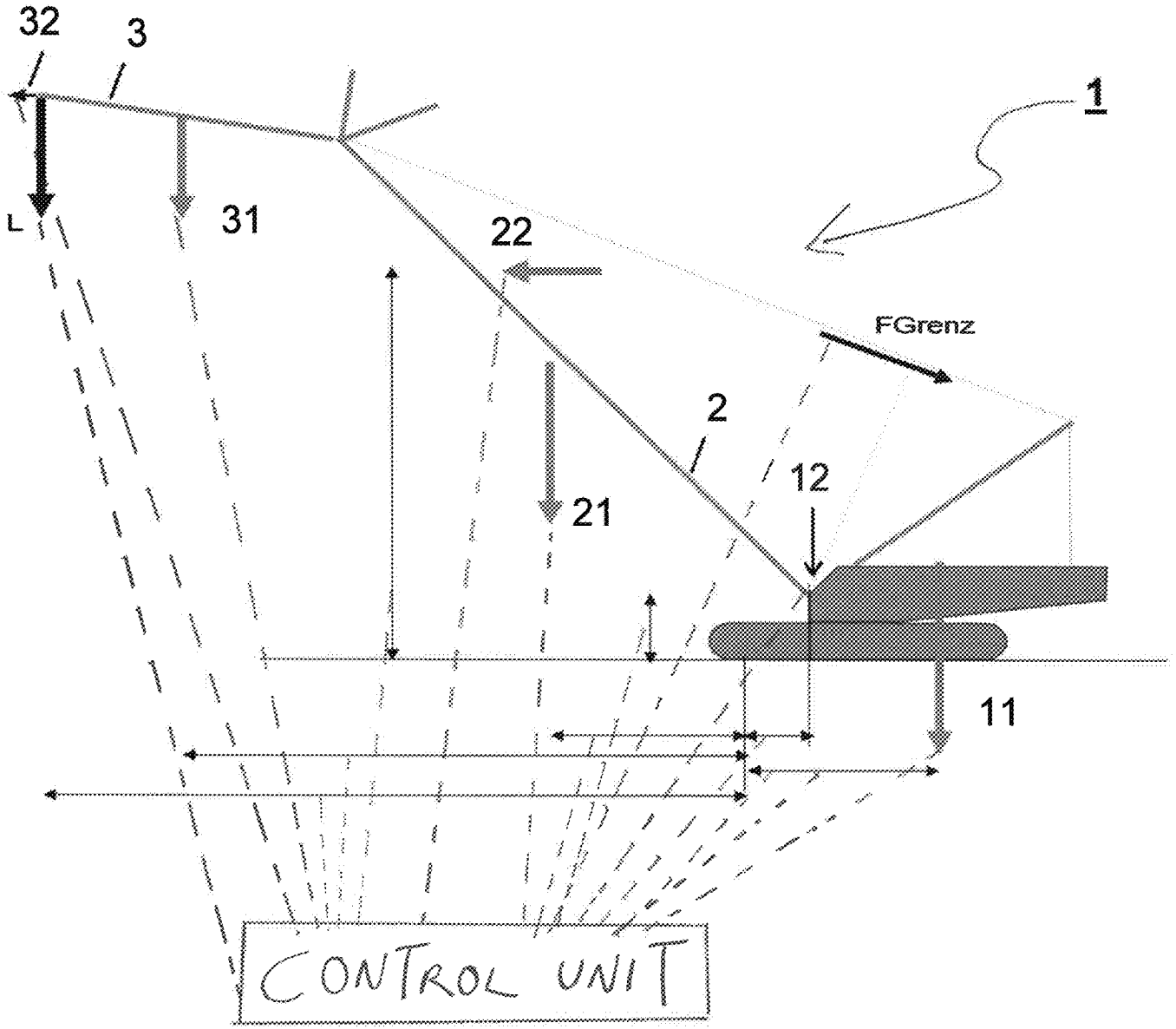
1
FGrenz
11
12
2
21
22
31
3
32
L
CONTROL UNIT

LIFTING DEVICE, IN PARTICULAR A MOBILE CRANE OR A CABLE-OPERATED EXCAVATOR, HAVING AN APPARATUS FOR MONITORING THE RAISING AND LOWERING PROCEDURES OF A BOOM SYSTEM AND CORRESPONDING METHOD

BACKGROUND OF THE INVENTION

The invention relates to a lifting device, in particular a mobile crane or a cable-operated excavator, having an apparatus for monitoring the raising and lowering procedures of a boom system of the lifting device.

It is known from the prior art that lifting devices such as mobile cranes having a rated capacity of at least 1000 kg or having an overturning moment of at least 40,000 Nm as per product standard EN 13000 have to be fitted with a rated capacity limiter that prevents the lifting device from being operated outside the limits specified in a rated capacity table for radii, positions and loads and the permitted rope forces.

The rated capacity limiter is typically based on precalculated payload tables that are prepared beforehand on external computers during the crane configuration and that are transmitted in tabular form to a control of the lifting device. It is also known to implement the rated capacity limiter at the running time of the device in which the calculation takes place directly in the control of the lifting device, with configuration files stored in the control of the lifting device being correspondingly processed or calculated.

On assembly/dismantling procedures and in raising and lowering procedures in which no payload table from a manufacturer of the lifting device is present, the rated capacity limiter can be bridged by means of a setup sensor and a corresponding setup procedure can be carried out without a safeguard.

In accordance with the product standard EN 474-12, cable-operated excavators in use as lifting devices have to have a load torque limiter to avoid an overload of the cable-operated excavator. A limiting of the overload during the raising or lowering procedures of a boom system is in contrast not provided.

As a rule, the raising and lowering takes place on the basis of detailed procedural descriptions in the operating instructions of the corresponding lifting device. Methods of monitoring the crane safety during setup procedures such as in the assembly or dismantling or the raising and lowering of the boom system in mobile cranes and cable-operated excavators are furthermore known from the prior art. The calculation of the limit values also takes place here on the basis of a calculation on an external computer that is transmitted in tabular form to the control of the lifting device.

One problem here is that when limit values are reached, a switch-off of the movements of the lifting device takes place that can only be canceled by an override switch. All the monitoring is switched off by actuating the override and the crane operator himself has to decide which movement on the crane can produce a safe state.

SUMMARY OF THE INVENTION

Against this background, it is the object of the invention to provide an improved lifting device in which in particular an improved and continuous monitoring of a boom system of the lifting device is made possible on raising and lowering procedures.

This object is achieved in accordance with the invention by a lifting device having the features herein. Advantageous embodiments are the subject of the description herein.

A lifting device, in particular a mobile crane or a cable-operated excavator, is accordingly provided having an apparatus for monitoring the raising and lowering procedures, in particular of a boom system of the lifting device.

The lifting device comprises a device for detecting the loads increasing the overturning moment of the lifting device; a device for detecting the loads stabilizing or reducing the overturning moment of the lifting device; a control unit that is configured to calculate a limit holding force for a holding line of the boom system of the lifting device from the detected loads that corresponds to the maximum permitted load at the hook; and a device for detecting the actual holding force of the holding line of the lifting device, wherein the control unit is configured to compare the limit holding force and the actual holding force.

In accordance with the invention, all the loads increasing the overturning moment such as a load at the hook, the weight of the boom system, and the wind force acting on the boom system and on the load at the hook are compared with all the loads that stabilize or reduce the overturning moment. They in particular include the weight of a carrier unit of the lifting device.

Corresponding calculation specifications for tilt security of the respective standards such as EN 13000 can be taken into account in this comparison and a maximum permitted load at the hook can be calculated for the most extreme load point so that the stabilizing moment is in equilibrium with the overturning moment with respect to the given overturning edge.

The limit holding force that corresponds to the maximum permitted load at the hook can be calculated for the holding line of the boom system that can comprise one or more holding ropes and/or holding rods.

It is conceivable in a preferred embodiment of the invention that at least one signal can be output in dependence on the comparison between the limit holding force and the actual holding force. The signal can be a representation of the current utilization with respect to the permitted utilization for the machine operator at the monitor of the lifting device or a warning signal and/or control signal that makes it possible to respond in a correspondingly good time if the actual holding force approaches the limit holding force and the risk of an overturning of the lifting device is thereby indicated.

It is conceivable in a further preferred embodiment of the invention that the device for detecting the loads increasing the overturning moment detects the weight of the boom system of the lifting device and the wind force on the boom system of the lifting device. The term 'boom system' can mean the main boom and optionally further components of the lifting device. The named devices for detecting the loads can be sensors and/or input means by means of which the corresponding loads can be automatically or manually detected and input.

It is conceivable in a further preferred embodiment that the device for detecting the loads stabilizing or reducing the overturning moment detects the weight of a carrier unit of the lifting device. The named devices for detecting the loads can be sensors and/or input means by means of which the corresponding loads can be automatically or manually detected and input.

It is conceivable in a further preferred embodiment that a sensor system is provided for detecting the current geometry of the lifting device. In this respect, corresponding angle meters or tilt indicators or other sensors can be configured to detect the angular positions or lengths of components of the lifting device such as in particular the holding line and/or the boom system. An additional or alternative manual input of the corresponding geometry data via a corresponding device is also conceivable.

It is conceivable in a further preferred embodiment that the calculation of the limit holding force takes place on an external computer and the limit values are transmitted to the control unit of the lifting device.

It is conceivable in a further preferred embodiment that the device for detecting the actual holding force of the holding line comprises at least one force measurement tab and/or at least one force measurement axis.

It is conceivable in a further preferred embodiment that the signal is a signal for stopping a movement of the lifting device. If the control unit of the lifting device in accordance with the invention determines that the limit holding force and the actual holding force are in an unfavorable ratio to one another, a movement of the lifting device can be automatically stopped.

It is conceivable in a further preferred embodiment that the control unit is configured to calculate the permitted load at the hook, i.e., loads increasing the overturning moment, simultaneously for a range of positions of the boom system in addition to the current position of the boom system. Permitted directions of movement can be defined by comparing the results. A permitted direction of movement is present when the maximum permitted load at the hook increases with this direction of movement.

Provision can be made in a further preferred embodiment that the control unit is configured not to stop a movement or a direction of movement of the lifting device as long as the limit holding force (FGrenz) is not exceeded, or to selectively release permitted directions of movement of the lifting device after a stop due to an exceeding of the limit load when maximum permitted load at the hook increases with the direction of movement.

The invention is further directed to a method of monitoring the raising and lowering procedures, in particular of a boom system of a lifting device such as a mobile crane or a cable-operated excavator in accordance with one of the claims 1 to 9. The method in accordance with the invention comprises the steps:

- detecting the loads increasing the overturning moment of the lifting device;
- detecting the loads stabilizing or reducing the overturning moment of the lifting device;
- calculating a limit holding force for a holding line of the boom system of the lifting device from the detected loads by means of a control unit or of an external computer;
- detecting the actual holding force of the holding line; and
- comparing the limit holding force and the actual holding force by means of the control unit.

The method can comprise further measures that correspond to at least one of the apparatus features and whose repetition is omitted.

BRIEF DESCRIPTION OF THE DRAWING

Further details and advantages of the invention are explained with reference to the embodiment shown by way of example in the FIGURE.

The only FIG. 1 shows an overview of the forces acting on the lifting device 1 for the example of a crawler crane 1 having a main boom 2 and a luffing needle 3.

DESCRIPTION OF THE PREFERRED EMBODIMENTS

The arrow 31 designates the weight of the luffing needle 3; the arrow 32 designates the wind force acting on the load L; the arrow 21 designates the weight of the main boom 2; the arrow 22 designates the wind force acting on the boom system consisting of the main boom 2 and the optional luffing boom 3; and the arrow 11 designates the weight of the carrier unit or to the lifting device 1. The unmarked arrows indicate the respective distances of the forces and/or centers of mass of the components with respect to an overturning edge and/or on the boom pivot point 12. The moments with respect to the boom pivot point 12 can be detected or calculated with reference to the distances and the forces.

In the embodiment of the FIGURE, the loads increasing the overturning moment act counter clockwise and the loads stabilizing the overturning moment act clockwise with respect to the boom pivot point 12.

The limit holding force FGrenz represents the maximum permitted force in the holding line that may be reached during the raising or lowering procedures without an overturning of the lifting device occurring. It corresponds to 100% of the permitted utilization while considering the specifications through relevant standards with respect to stability.

If the individual balance points and wind areas in particular of the luffing boom 3 and of the main boom 2 and the corresponding load engagement points for the given crane configuration of the control are known, the calculation of the maximum permitted load L at the hook and of the limit force FGrenz can advantageously take place online directly on the control computer of the crane.

The current geometry of the machine (boom angle, angle of rotation) required for a calculation carried out on the control can be permanently detected by corresponding sensor systems (inclinometer, rotary encoder) on the machine or can be manually input into the control computer.

Alternatively, the calculation of the maximum permitted load L at the hook and of the limit force FGrenz can take place offline via an external computer. The limit force FGrenz in this case has to be transferred to the control for every boom position. The current geometry of the machine (boom angle, angle of rotation) can also be measured permanently in this case by a corresponding sensor system on the machine.

The actual current force F in the holding line is measured by a corresponding sensor system (force measurement tabs or force measurement axes) on the machine and are compared by the control computer on the machine with the calculated current limit holding force FGrenz and are advantageously displayed to the machine operator on the monitor as the current utilization with respect to the permitted utilization.

If it is found that the current force F is or could be >FGrenz, i.e. the utilization is >100%, those movements of the boom system that result in a further increase of the utilization and thus in the overload can be stopped by the control unit.

The direction of movement or the movement that is to be stopped or released is determined as follows:

The control unit calculates the maximum permitted load at the hook simultaneously for a wide range of positions in addition to the current position of the boom system. Permitted directions of movement are defined by comparing the results. A permitted direction of movement is present when the maximum permitted load at the hook increases with this direction of movement.

After a stop due to an exceeding of the limit load, permitted directions of movement of the lifting device are selectively released again by the control unit.

The calculation of the range in addition to the current position can advantageously take place online on the control computer of the machine or alternatively offline on an external computer. The directions of movement to be released in this case have to be transferred to the control for every boom position.

The invention claimed is:

1. A lifting device (1), having an apparatus for monitoring raising and lowering procedures of a boom system of the lifting device (1), the apparatus comprising a device for detecting loads increasing an overturning moment of the lifting device (1);

a device for detecting loads stabilizing or reducing the overturning moment of the lifting device (1);

a control unit configured to calculate a limit holding force (FGrenz) for a holding line of the boom system of the lifting device (1) from the detected loads; and a device for detecting actual holding force of the holding line, wherein the control unit is configured to compare the limit holding force (FGrenz) and the actual holding force.

2. A lifting device (1) in accordance with claim 1, wherein the control unit is configured to output at least one signal in dependence on the comparison between the limit holding force (FGrenz) and the actual holding force.

3. A lifting device (1) at least in accordance with claim 2, wherein the at least one signal is a representation of the current utilization with respect to permitted utilization for a machine operator on a monitor of the lifting device and/or for stopping a movement of the lifting device (1).

4. A lifting device (1) in accordance with claim 1, wherein the device for detecting the loads increasing the overturning moment, detects the weight of the boom system and the wind force on a boom system of the lifting device (1).

5. A lifting device (1) in accordance with claim 1, wherein the device for detecting the loads stabilizing or reducing the overturning moment, detects the weight of a carrier unit of the lifting device.

6. A lifting device (1) in accordance with claim 1, wherein a sensor system for detecting the current geometry of the lifting device (1) is provided; and the control unit is a control computer of the lifting device (1) or an external computer.

7. A lifting device (1) in accordance with claim 1, wherein the device for detecting the actual holding force of the holding line, comprises at least one force measurement tab and/or at least one force measurement axis.

8. A lifting device (1) in accordance with claim 1, wherein the control unit is configured to calculate the loads increasing the overturning moment simultaneously for a wide range of positions of the boom system in addition to current position of the boom system.

9. A lifting device (1) in accordance with claim 1, wherein the control unit is configured not to stop a movement or a direction of movement of the lifting device (1) as long as the limit holding force (FGrenz) is not exceeded or to selectively release the movement or the direction of movement again after a stop due to an exceeding of the limit load, when maximum permitted load at a lifting hook hook increases with the direction of movement.

10. A lifting device (1) in accordance with claim 1, which is a mobile crane or a cable-operated excavator.

11. A method of monitoring the raising and lowering procedures of a boom system of a lifting device (1), comprising the steps of:

detecting loads increasing overturning moment of the lifting device (1);

detecting the loads stabilizing or reducing the overturning moment of the lifting device (1);

calculating a limit holding force (FGrenz) for a holding line of a main boom (2) of the lifting device (1) from the detected loads, by a control unit;

detecting actual holding force of the holding line; and comparing the limit holding force (FGrenz) and the actual holding force by the control unit.

12. A method in accordance with claim 11, wherein the lifting device (1) is a mobile crane or a cable-operated excavator.

* * * * *